US008164236B2

(12) United States Patent
Huang et al.

(10) Patent No.: US 8,164,236 B2
(45) Date of Patent: Apr. 24, 2012

(54) LAMP ASSEMBLY

(75) Inventors: Tien-Fu Huang, Hsinchu County (TW); Chen-Dao Shiao, Hsinchu (TW); Chi-Hua Yu, Hsinchu (TW); Kuo-An Wu, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 120 days.

(21) Appl. No.: 12/834,843

(22) Filed: Jul. 12, 2010

(65) Prior Publication Data

US 2011/0254425 A1 Oct. 20, 2011

(30) Foreign Application Priority Data

Apr. 19, 2010 (TW) ..... 99112125 A

(51) Int. Cl.
*H01J 1/02* (2006.01)
*H01J 7/24* (2006.01)
*F21V 29/00* (2006.01)

(52) U.S. Cl. ..... 313/46; 313/11; 362/294

(58) Field of Classification Search ..... None
See application file for complete search history.

(56) References Cited

U.S. PATENT DOCUMENTS

| | | | | |
|---|---|---|---|---|
| 6,787,999 | B2 | 9/2004 | Stimac et al. | |
| 6,864,513 | B2 | 3/2005 | Lin et al. | |
| 7,144,140 | B2 * | 12/2006 | Sun et al. | 362/373 |
| 7,458,706 | B1 | 12/2008 | Liu et al. | |
| 7,513,653 | B1 | 4/2009 | Liu et al. | |
| 7,549,772 | B2 * | 6/2009 | Wang | 362/294 |
| 7,549,774 | B2 | 6/2009 | Tsai | |
| 7,568,817 | B2 | 8/2009 | Lee et al. | |
| 7,575,346 | B1 | 8/2009 | Horng et al. | |
| 7,637,635 | B2 * | 12/2009 | Xiao et al. | 362/294 |
| 7,637,636 | B2 | 12/2009 | Zheng et al. | |
| 7,670,028 | B2 * | 3/2010 | Liu et al. | 362/294 |
| 7,824,077 | B2 * | 11/2010 | Chen et al. | 362/345 |
| 7,959,332 | B2 * | 6/2011 | Tickner et al. | 362/373 |
| 7,993,034 | B2 * | 8/2011 | Wegner | 362/296.05 |
| 2007/0236935 | A1 * | 10/2007 | Wang | 362/294 |
| 2009/0129102 | A1 | 5/2009 | Xiao et al. | |
| 2009/0147520 | A1 | 6/2009 | Liu et al. | |

FOREIGN PATENT DOCUMENTS

| | | |
|---|---|---|
| TW | M278059 | 10/2005 |
| TW | M330426 | 4/2008 |
| TW | M353309 | 3/2009 |

* cited by examiner

*Primary Examiner* — Natalie Walford

(57) ABSTRACT

A lamp assembly is provided, including a light source, a thermal module, a connecting member, and an adapter electrically connected to the light source. The thermal module includes a first thermal member and a second thermal member which are formed by a die casting process, wherein the light source is disposed on the second thermal member. The first and second thermal members respectively have a plurality of first and second fins which are arranged in a staggered manner. The connecting member is formed by a metal extrusion process and extends through the first thermal member to connect the second thermal member with the adapter.

10 Claims, 5 Drawing Sheets

LAMP ASSEMBLY

CROSS REFERENCE TO RELATED APPLICATIONS

This Application claims priority of Taiwan Patent Application No. 099112125, filed on Apr. 19, 2010, the entirety of which is incorporated by reference herein.

BACKGROUND OF THE INVENTION

1. Field of the Invention

This application relates in general to a lamp assembly and in particular to an LED lamp assembly.

2. Description of the Related Art

As LEDs have low power dissipation and long endurance, they have been widely applied in various lamp apparatuses. Conventional LED lamps may comprise several metal fins for heat dissipation, so as to prevent failure due to overheating.

The metal fins are usually formed by die extrusion or die casting. However, the die extrusion process is expensive and forming complex structures therewith is difficult. As for the die casting process, manufacturing fin structures with fine pitches and durable strengths is difficult. Accordingly, it has been difficult to manufacture low cost lamp assemblies with fin structures having high cooling efficiency.

BRIEF SUMMARY OF INVENTION

The application provides a lamp assembly including a light source, a thermal module, a connecting member, and an adapter electrically connected to the light source. The thermal module includes a first thermal member and a second thermal member which are formed by a die casting process, wherein the light source is disposed on the second thermal member. The first and second thermal members respectively have a plurality of first and second fins which are arranged in a staggered manner. The connecting member is formed by a metal extrusion process and extends through the first thermal member to connect the second thermal member with the adapter.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
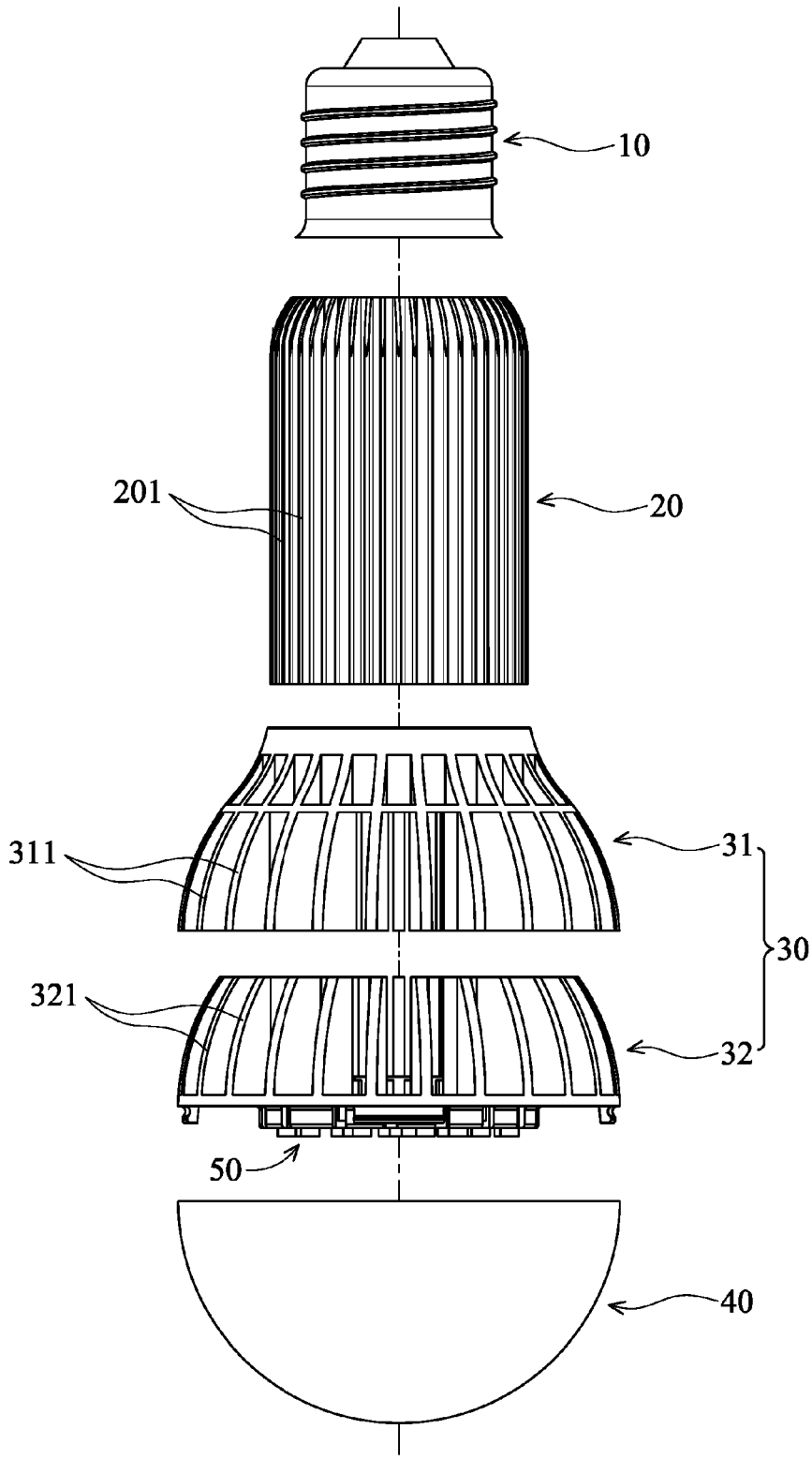
FIG. 1 is an exploded diagram of a lamp assembly according to an embodiment of the invention.
Figure 2:
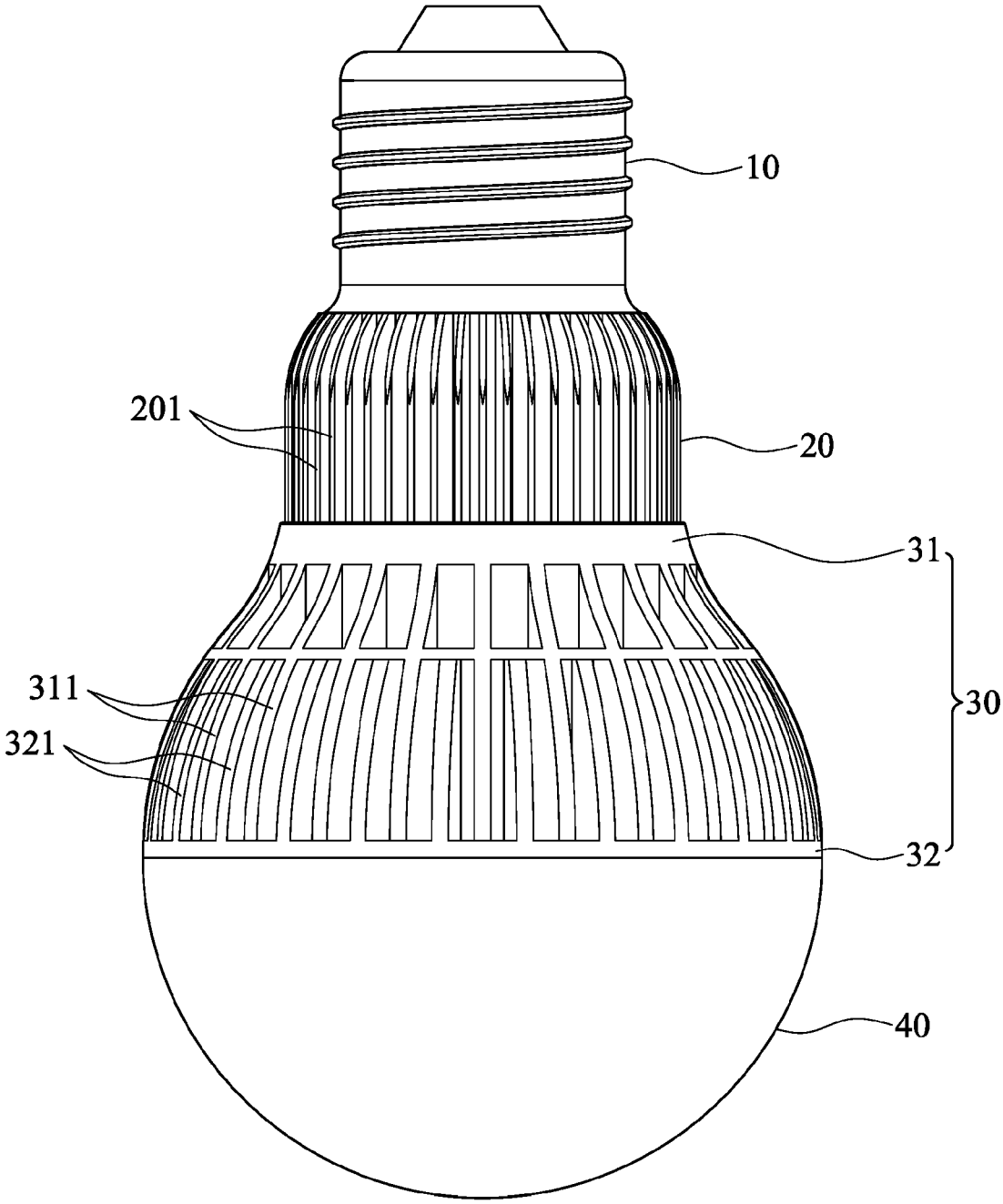
FIG. 2 is a perspective diagram of the lamp assembly in FIG. 1.

Referring to FIGS. 1 and 2, an embodiment of a lamp assembly primarily comprises an adapter 10, a connecting member 20, a thermal module 30, a shield 40, and at least a light source 50. In this embodiment, the light source 50 may be an LED, and the adapter 10 may be an E27 adapter electrically connected to the light source 50. Additionally, the connecting member 20 and the thermal module 30 may comprise aluminum or other materials with high thermal efficiency, wherein the thermal module 30 includes a first thermal member 31 and a second thermal member 32 which are made by a die casting process, and the connecting member 20 is made by a metal extrusion process.

As shown in FIGS. 1 and 2, the first thermal member 31 has a plurality of first fins 311, and the second thermal member 32 has a plurality of second fins 321. The first and second thermal members 31 and 32 are respectively formed by a die casting process (such as an aluminum die casting process). During assembly, the first and second thermal members 31 and 32 are engaged with each other, wherein the first and second fins 311 and 321 are arranged in a staggered manner. In FIG. 1, the light source 50 is disposed on the bottom side of the second thermal member 32, wherein the shield 40 connects to the second thermal member 32 and encompasses the light source 50.

During the die casting process, since a fine pitch between adjacent fin structures is hard to achieve, the number of fin structures is adversely limited. To overcome the drawbacks of the die casting process, the present application provides a thermal module 30 including a first thermal member 31 and a second thermal member 32 engaged with each other, wherein the first and second fins 311 and 321 are arranged in a staggered manner to multiply the number of fins used; thus, increasing the surface area thereof and improving cooling efficiency.

Figure 3:
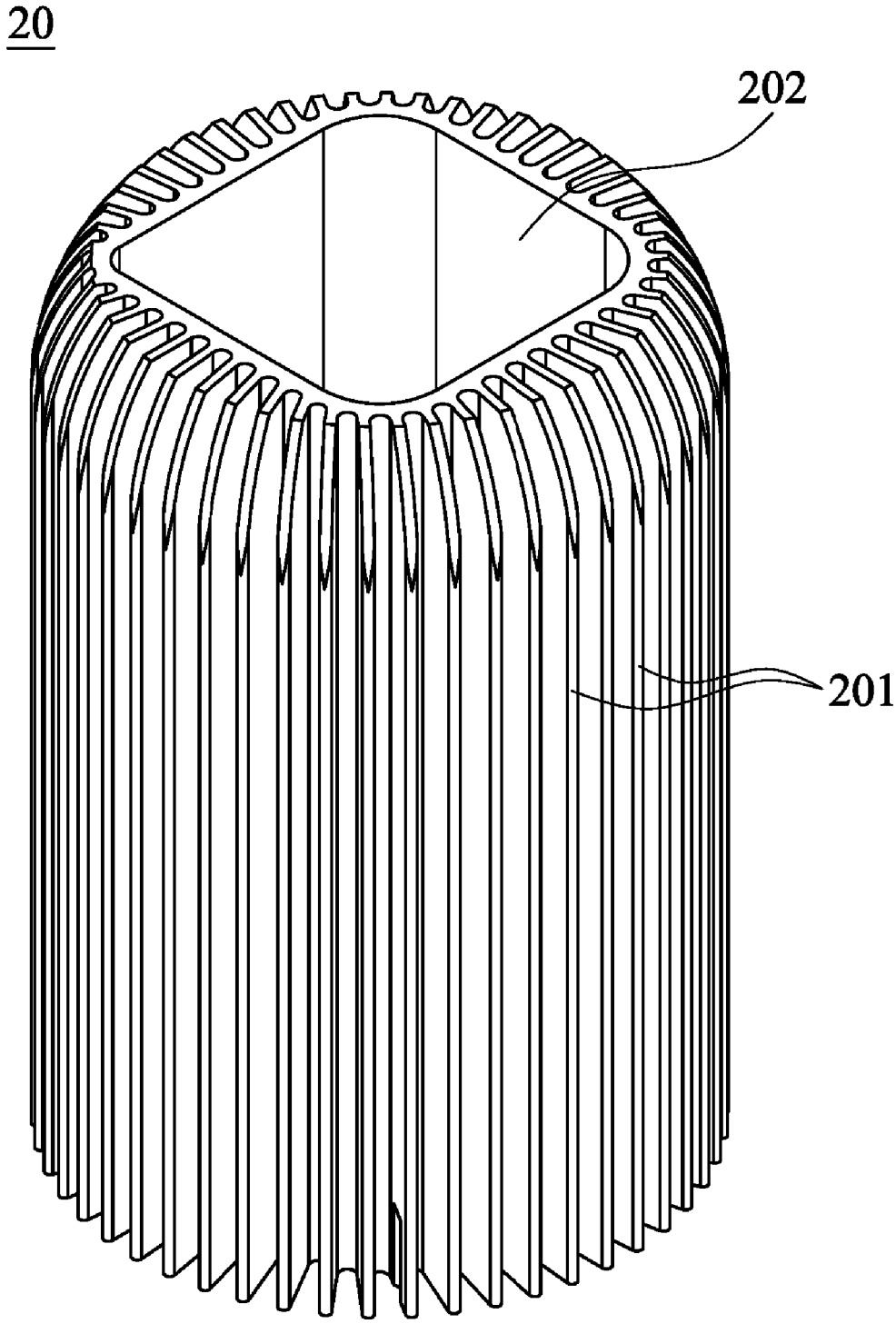
FIG. 3 is a perspective diagram of a connecting member according to an embodiment of the invention.

Referring to FIG. 3, an embodiment of the connecting member 20 is formed by a metal extrusion process (such as an aluminum extrusion process). Circuit boards and other electrical components (not shown) can be disposed in a central hole 202 of the connecting member 20, to electrically connect the adaptor 10 with the light source 50. As shown in FIG. 3, the connecting member 20 has a plurality of thermal fins 201 around the central hole 202 to increase surface area thereof.

Figure 4:
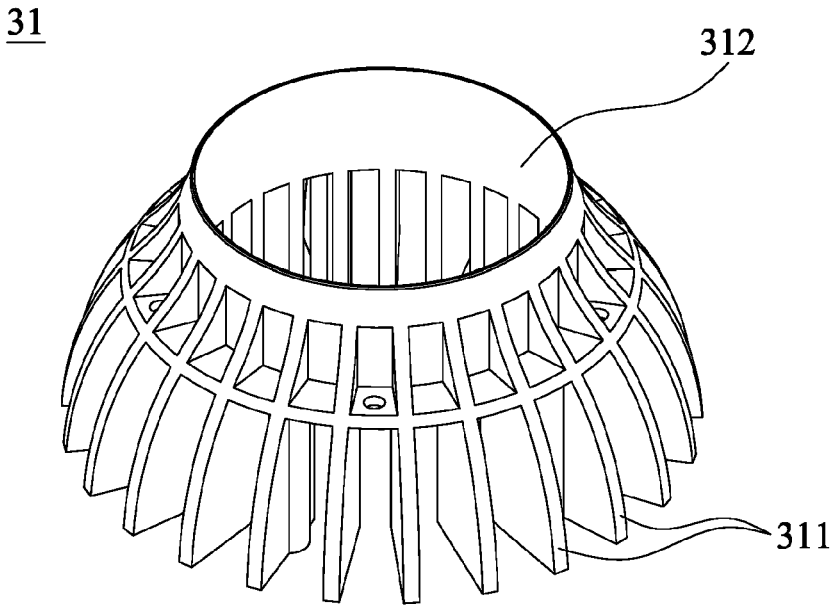
FIGS. 4 and 5 are perspective diagrams of a first thermal member according to an embodiment of the invention.
Figure 5:
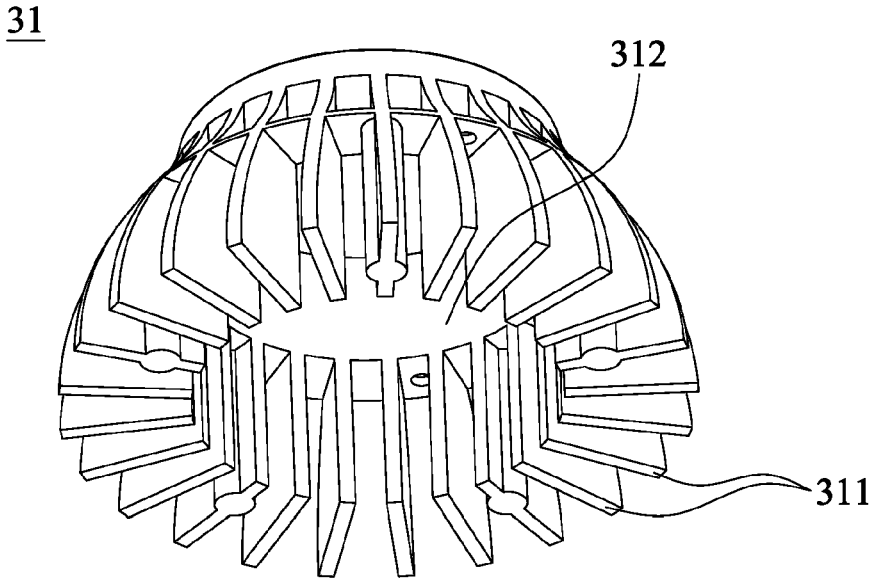
Figure 6:
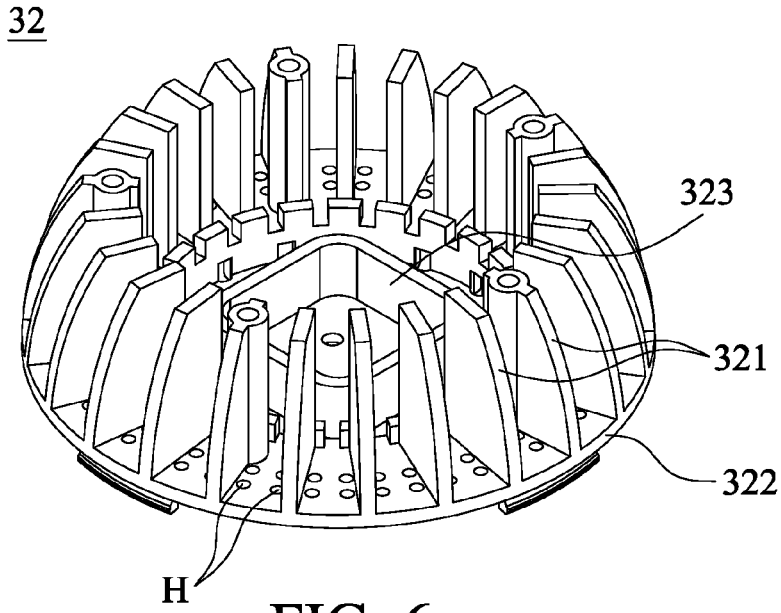
FIGS. 6 and 7 are perspective diagrams of a second thermal member according to an embodiment of the invention.

Referring to FIGS. 4 and 5, the first thermal member 31 has a round opening 312 size corresponding to the connecting member 20. The first thermal member 31 further has a plurality of first fins 311 radially formed around the round opening 312. Referring to FIG. 6, the second thermal member 32 comprises a base 322 and a plurality of second fins 321 radially disposed on the base 322, wherein the second fins 321 are substantially perpendicular to the base 322. When assembling the first and second thermal members 31 and 32, the first and second fins 311 and 321 are arranged in a staggered manner as shown in FIG. 2. The connecting member 20 is extended through the opening 312 of the first thermal member 31 and fixed to a connection portion 323 of the second thermal member 32.

Figure 7:
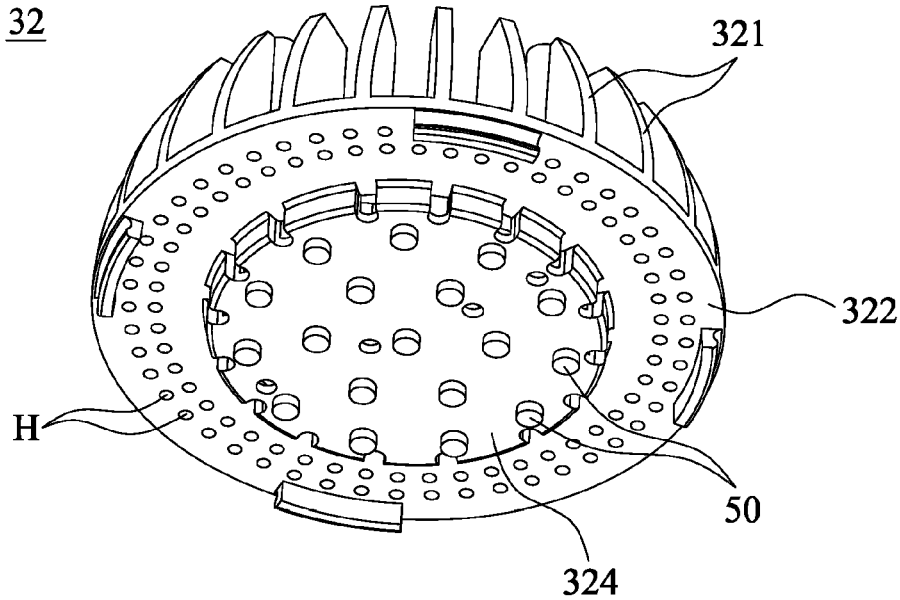

Referring to FIG. 7, the second thermal member 32 has a pedestal 324 with the light source 50 disposed thereon. The second fins 321 and the pedestal 324 are disposed on opposite sides of the base 322. In this embodiment, the base 322 comprises a plurality of through holes H distributed around the pedestal 324, so that heat generated from the light source 50 can be rapidly dissipated by air convection through the through holes H, and overheating and failure of the light source 50 may be prevented.

The present application provides a lamp assembly including a thermal module, a light source disposed on the thermal module, an adapter, and a connecting member. Specifically, the thermal module includes a first thermal member and a second thermal member which are formed by a die casting process, such as an aluminum die casting process. The first and second thermal members respectively have a plurality of first and second fins which are arranged in a staggered manner to multiply the number of fins used; thus, increasing the surface area thereof and improving cooling efficiency. Additionally, the connecting member is formed by a metal extrusion process, such as an aluminum extrusion process, to connect the second thermal member with the adapter.

Since a metal extrusion process can produce fin structures with fine pitch and high strength, and a die casting process can produce complex fin structures with low cost, the two processes are respectively applied to produce a connecting member and a thermal module of the lamp assembly, so as to achieve low cost and high cooling efficiency thereof.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A lamp assembly, comprising:

a thermal module, comprising a first thermal member and a second thermal member which are made by a die casting process, wherein the first and second thermal members respectively form a plurality of first and second fins which are arranged in a staggered manner;

a light source, disposed on the second thermal member;

an adapter, electrically connected to the light source; and a connecting member, extending through the first thermal member and connecting the adapter with the second thermal member, wherein the connecting member is made by a metal extrusion process and forms a plurality of thermal fins.

2. The lamp assembly as claimed in claim 1, wherein the second thermal member further forms a base and a pedestal, the light source is disposed on the pedestal, and the second fins and the pedestal are disposed on opposite sides of the base.

3. The lamp assembly as claimed in claim 2, wherein the base has a plurality of through holes.

4. The lamp assembly as claimed in claim 3, wherein the through holes are distributed around the pedestal.

5. The lamp assembly as claimed in claim 1, wherein the first and second thermal members are formed by an aluminum die casting process.

6. The lamp assembly as claimed in claim 1, wherein the connecting member is made by an aluminum extrusion process.

7. The lamp assembly as claimed in claim 1, wherein the first and second fins are radially arranged around the first and second thermal members.

8. The lamp assembly as claimed in claim 1, wherein the light source comprises an LED.

9. The lamp assembly as claimed in claim 1, wherein the adapter is an E27 adaptor.

10. The lamp assembly as claimed in claim 1, wherein the lamp assembly further comprises a shield connecting to the second thermal member and encompassing the light source.

* * * * *